US006406559B2

(12) United States Patent
Sakurada et al.

(10) Patent No.: US 6,406,559 B2
(45) Date of Patent: Jun. 18, 2002

(54) MAGNETIC MATERIAL AND MANUFACTURING METHOD THEREOF, AND BONDED MAGNET USING THE SAME

(75) Inventors: Shinya Sakurada, Tokyo; Takahiro Hirai, Kamakura; Keisuke Hashimoto; Tomohisa Arai, both of Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/903,237

(22) Filed: Jul. 13, 2001

Related U.S. Application Data

(62) Division of application No. 09/144,470, filed on Aug. 31, 1998, now abandoned.

(30) Foreign Application Priority Data

Sep. 1, 1997 (JP) ..... 9-236102

(51) Int. Cl.[7] ..... H01F 1/057; H01F 1/059
(52) U.S. Cl. ..... 148/122; 148/101
(58) Field of Search ..... 148/101, 122

(56) References Cited

U.S. PATENT DOCUMENTS 5,186,766 A * 2/1993 Iriyama et al. ..... 148/301
5,716,462 A * 2/1998 Sakurada et al. ..... 148/302
5,720,828 A * 2/1998 Strom-Olsen et al. ..... 148/104
5,968,289 A * 10/1999 Sakurada et al. ..... 148/302

* cited by examiner

*Primary Examiner*—John Sheehan
(74) *Attorney, Agent, or Firm*—Oblon, Spivak, McClelland, Maier & Neustadt, P.C.

(57) ABSTRACT

A magnetic material essentially consists of a composition represented by general formula: $R^1{}_X R^2{}_Y B_Z N_U H_V M_{100-X-Y-Z-C-V}$ (in the formula, $R^1$ denotes at least one kind element selected from rare earth elements, $R^2$ denotes at least one kind element selected from Zr, Hf and Sc, M denotes at least one kind element selected from Fe and Co, X, Y, Z, U and V are numbers satisfying 2 at. %≦X, 0.01 at. %≦Y, 4≦X+Y≦20 at. %, 0≦Z≦10 at. %, 0.1≦U≦18 at. %, 0.01≦V≦10 at. %, respectively), and comprises a $TbCu_7$ type crystal phase as a principal phase. A nitriding treatment to a mother alloy is carried out in a mixed gas of ammonia gas and hydrogen gas of which partial pressure ratio is set in the range of $3<P_y/P_x$ when partial pressure of ammonia gas is $P_X$, that of the hydrogen gas is $P_y$. According to such a nitriding treatment, without hindering rapid absorption of nitrogen by a mother alloy of which principal phase is a $TbCu_7$ type crystal phase, deterioration of magnetic characteristics due to too much absorption of nitrogen can be suppressed.

16 Claims, No Drawings

MAGNETIC MATERIAL AND MANUFACTURING METHOD THEREOF, AND BONDED MAGNET USING THE SAME

This application is a Division of application Ser. No. 09/144,470 filed on Aug. 31, 1998, now abandoned.

BACKGROUND OF THE INVENTION

1. Field of the Invention

The present invention relates to a magnetic material capable of being used as a permanent magnet of high performance and the like and a manufacturing method thereof, and a bonded magnet using the same.

2. Description of the Related Art

As one kind of rare earth permanent magnets of high performance, Sm—Co based magnet, Nd—Fe—B based magnet and the like have been known. These magnets contain much Fe and Co, these elements contributing in enhancement of saturation magnetic flux density. Further, rare earth elements in these magnets, due to behavior of 4f electrons in crystal field, induce a very large magnetocrystalline anisotropy. Thereby increase of coercive force is attained, realizing magnets of high performance.

Such high performance magnets are being used mainly for speakers, motors, electric instruments such as measuring instruments. In recent years, demand for miniaturization of various kinds of electric instruments has become strong, in order to respond it, permanent magnets of more higher performance are expected. To this demand, a $TbCu_7$ type compound excellent in its magnetic property and compounds thereto nitrogen is made to be contained are proposed (refer to Japanese Patent Laid-Open Application No. Hei-6-172936, Japanese Patent Laid-Open Application No. Hei-9-74006 and the like).

A magnetic material having a phase in which a $TbCu_7$ type crystal structure (hereinafter refers to as $TbCu_7$ type crystal phase) is a principal phase is manufactured with the manufacturing process shown in the following. First, mother alloy is produced with melt-spun method or mechanical alloying method. Then, to this mother alloy, heat treatment is given with a main object to control its metallic texture. Further, by introducing nitrogen into interstitial sites of the principal phase, nitriding treatment with a main object to heighten the magnetocrystalline anisotropy of the principal phase is implemented.

The nitriding process is usually carried out in an atmosphere containing gas of nitrogen compounds such as nitrogen gas and ammonia. By heat treating in such an atmosphere containing nitrogen to make absorb it in the mother alloy, nitrogen is introduced in magnetic material. To make rapidly absorb nitrogen in the magnetic material, employment of gas containing hydrogen such as ammonia or a mixed gas of ammonia and hydrogen gas is known to be effective.

For instance, in Japanese Patent Laid-Open Applications No. Hei-2-57663 and Hei-3-16102, a manufacturing method of a magnetic material is disclosed wherein, by heat treating a mother alloy, of which a phase possessing a $Th_2Zn_{17}$ type crystal structure (hereinafter referred to as $Th_2Zn_{17}$ type crystal phase) is a principal phase, in a gas mixed ammonia gas and hydrogen gas with a partial pressure ratio of 1:2 to 1:3, nitrogen, further hydrogen is made contained in the aforementioned mother alloy.

However, upon manufacturing a magnetic material having a $TbCu_7$ type crystal phase as a principal phase, if heat the treatment of a mother alloy is carried out in a mixed gas of ammonia gas and hydrogen gas mixed with a partial pressure ratio of 1:2 to 1:3, too much nitrogen is absorbed, thereby amorphous portion increases to result in a problem of deteriorating magnetic characteristics.

Thus, in a magnetic material which has a $TbCu_7$ type crystal phase as a principal phase, upon a mother alloy being subjected to a nitriding treatment, a technology, which, without hindering rapid absorption of nitrogen, controls too much absorption of nitrogen, is demanded. Thereby, the amorphous portion in a magnetic material can be prevented from being increased.

SUMMARY OF THE INVENTION

Therefore, an object of the present invention is, upon carrying out nitriding treatment to a mother alloy in which a $TbCu_7$ type crystal phase is a principal phase, without hindering a rapid absorption of nitrogen, to suppress deterioration of magnetic characteristics due to too much absorption of nitrogen. In more specific, by suppressing increase of the amorphous phase due to too much absorption of nitrogen, it is to provide a magnetic material which made possible to obtain efficiently excellent magnetic characteristics and a bonded magnet using the same. Further, it is to provide a manufacturing method of a magnetic material which made possible to manufacture such a magnetic material efficiently with excellent reproducibility.

The present inventors, after much study with an intention to accomplish the aforementioned object, have found that, when a mother alloy having a $TbCu_7$ type crystal phase as a principal phase is subjected to nitriding treatment with a mixed gas containing ammonia gas and hydrogen gas, by remarkably reducing partial pressure of ammonia gas than that of hydrogen gas, without hindering rapid absorption of nitrogen, the amount of nitrogen intruding into crystal can be readily controlled. Incidentally, the main phase in the present invention is specified as a phase which occupies the maximum volume among the constituting crystalline phases and non-crystalline phases.

That is, a mother alloy which is manufactured with liquid rapid cooling method or mechanical alloying method and has a $TbCu_7$ type crystal phase as a principal phase can be made such fine as a grain diameter of, for instance, 50 nm or less. Such a micro-crystalline alloy, upon being subjected to the nitriding treatment with a mixed gas containing ammonia gas and hydrogen gas, compared with an alloy large in its grain diameter such as, for instance, $Sm_2Fe_{17}$ alloy of which principal phase is $Th_2Zn_{17}$ type crystal phase, too much nitrogen is prone to be absorbed. As a result, a magnetic material which has a $TbCu_7$ type crystal phase as a principal phase is supposed to be made amorphous readily.

Thus, when a micro-crystalline alloy of which the principal phase is a $TbCu_7$ type crystal phase is used as a mother alloy, by reducing partial pressure of ammonia gas, without increasing amorphous phase in magnetic material, nitrogen necessary and sufficient for an over-all crystal can be rapidly fed. Further, the obtained magnetic material contains a small quantity of hydrogen. In a magnetic material of which the principal phase is a $TbCu_7$ type crystal phase containing a small quantity of hydrogen, without lowering its manufacturing efficiency, excellent magnetic characteristics can be obtained with excellent reproducibility.

The present invention was accomplished based on such knowledge. That is, a magnetic material of the present invention is essentially consisting of a composition expressed by a general formula $$R^1{}_X R^2{}_Y B_Z N_U H_V M_{100-X-Y-Z-C-V} \quad (1)$$

(wherein, $R^1$ denotes at least one kind element selected from rare earth elements, $R^2$ denotes at least one kind element selected from Zr, Hf and Sc, M denotes one kind element selected from Fe and Co, X, Y, Z, U and V are numbers satisfying 2 at. %≦X, 0.01 at. %≦Y, 4≦X+Y≦20 at. %, 0≦Z≦10 at. %, 0.1≦U≦18 at. %, 0.01≦V≦10 at. %, respectively), the magnetic material is characterized in possessing a $TbCu_7$ type crystal phase as a principal phase.

A manufacturing method of the magnetic material of the present invention comprises a step of preparing a mother alloy of which the principal phase is a $TbCu^7$ type crystal phase, and a step of making contain nitrogen in the mother alloy by heat treating the mother alloy in a mixed gas containing ammonia gas and hydrogen gas and satisfying a partial pressure ratio of $3<P_y/P_x$, when partial pressure of the ammonia gas is $P_X$, that of the hydrogen gas is $P_y$.

A bonded magnet of the present invention is characterized in casting in a desired shape a mixture of the aforementioned magnetic material of the present invention and a binder.

DESCRIPTION OF THE PREFERRED EMBODIMENTS

In the following, embodiments for carrying out the present invention will be described.

Magnetic material of the present invention has a composition expressed essentially by the aforementioned formula (1), and a $TbCu_7$ type crystal phase (a phase having a $TbCu_7$ type crystal structure) as its principal phase. First, reason compounding each component of the magnetic material of the present invention and reason defining compounding amount of each element will be described.

Rare earth elements as $R^1$ element are elements to give a large magnetocrystalline anisotropy to magnetic material, thereby contributing to a high coercive force. As such $R^1$ elements, La, Ce, Pr, Nd, Sm, Eu, Gd, Tb, Dy, Ho, Er, Tm, Lu, Y can be used. Among them, $R^1$ elements in particular are preferred to contain 50 at. % or more of Sm. Thereby, magnetocrystalline anisotropy of the principal phase can be heightened, coercive force can be increased. In this case, aside from Sm, it is preferred to be Pr and Nd.

The content X of the aforementioned $R^1$ element is set to at least 2 at. % or more. If the content of the $R^1$ element is 2 at. % or less, magnetocrystalline anisotropy decreases remarkably, resulting in difficulty of obtaining a magnetic material of a large coercive force. On the other hand, if the $R^1$ element is contained much, saturation magnetic flux density of the magnetic material deteriorates. The content of the $R^1$ element X is more preferable to be in the range of 4≦X≦16 at. %.

$R^2$ element is at least one kind element selected from Zr, Hf and Sc. Such $R^2$ element occupies mainly rare earth sites in the principal phase, having an effect to make smaller the average atomic radius of the rare earth sites. Thereby, Fe and Co concentration in the $TbCu_7$ type crystal phase which is a principal phase can be heightened. Further, the $R^2$ element also contributes in increasing the coercive force of the magnetic material. The content Y of the $R^2$ element, upon obtaining the aforementioned operation effect, is set at 0.01 at. % or more. More preferable content Y of the $R^2$ element is in the range of 0.1≦Y≦10 at. %, further preferable to be in the range of 1≦Y≦3 at. %.

Total amount of $R^1$ element and $R^2$ element is set at 4 at. % or more to let magnetic material have more higher coercive force. When the total amount of $R^1$ element and $R^2$ element is less than 4 at. %, precipitation of α-Fe (Co) becomes remarkable, resulting in lowering of coercive force of the magnetic material. On the other hand, if the total amount of $R^1$ element and $R^2$ element exceeds 20 at. %, lowering of magnetization of saturation magnetic flux density becomes large. Therefore, the total amount (X+Y) of $R^1$ element and $R^2$ element is set in the range of 4≦X+Y≦20 at. %. The total amount (X+Y) of $R^1$ element and $R^2$ element is more preferable to be set in the range of 4≦X+Y≦16 at. %.

M element is at least one kind of element selected from Fe and Co and is a fundamental element upon realizing a large saturation magnetic flux density of magnetic material. M element, by making contain 70 at. % or more in a magnetic material, can effectively increase saturation magnetic flux density.

Part of the M element may be replaced by at least one kind of element (hereinafter referred to as T element) selected from Ti, V, Cr, Mo, W, Mn, Ga, Al, Sn, Ta, Nb, Si and Ni. By replacing part of the M element with T element, ratio of the principal phase occupying in the over-all magnetic material can be increased, further, total amount of the M element and the T element in the principal phase can be increased. Further, the coercive force of the magnetic material can be increased. However, if the M element is replaced with too much of the T element, lowering and so on of saturation magnetic flux density is induced, therefore, the amount of the M element to be replaced by the T element is preferable to be 20 at. % or less. From the view point of obtaining magnetic material high in its saturation magnetic flux density, Fe amount in the total amount of the M element and the T element is preferable to be 50 at. % or more.

B (boron) is an element effective in obtaining magnetic material high in its residual magnetic flux density. However, if the content of B exceeds 10 at. %, in heat treatment process and the like, an $R_2Fe_{14}B$ phase is prone to be generated, resulting in deterioration of magnetic characteristics. Therefore, the content Z of B is set at 10 at. % or less. The content of B is more preferable to be set at 4 at. % or less, further preferable to be set at 2 at. % or less. On the other hand, since enhancement of residual magnetic flux density due to compounding of B becomes obvious around 0.001 at. %, the content of B is preferable to be set at 0.001 at. % or more, further more preferable to be set at 0.1 at. % or more.

N (nitrogen) exists mainly in the interstitial sites of the principal phase, compared with a case not containing N, Curie temperature and magnetocrystalline anisotropy of the principal phase are enhanced. Though nitrogen exhibits its effect by compounding a small quantity, when exceeding 18 at. %, amorphous phase is prone to be formed, resulting in deterioration of magnetic characteristics of magnetic material. Therefore, the content U of N is set in the range of 0.1≦U≦18 at. %. More preferable content U of N is in the range of 2≦U≦18 at. %, further preferable to be in the range of 5≦U≦17 at. %.

Part of N may be replaced with at least one kind element selected from C and P, thereby magnetic characteristics such as coercive force and the like can be improved. However, if too much of nitrogen is replaced by C or P, enhancement effect of Curie temperature and magnetocrystalline anisotropy of the principal phase is decreased, therefore, the amount of N to be replaced by C or P is preferable to be 50 at. % or less.

H (hydrogen) is introduced into magnetic material by heat treating in a mixed gas containing ammonia gas and hydrogen gas which will be described later in detail, and, as identical as N, exists mainly in the interstitial sites of the principal phase. By introducing H into magnetic material of which the $TbCu_7$ type crystal phase is the principal phase, in the heat treatment in an atmosphere of which the content of nitrogen is small, N of necessary and sufficient amount can be made possible to be introduced effectively and rapidly into magnetic material. In other words, by introduction of H, N can be made to be diffused in short time into magnetic material from an atmosphere where nitrogen amount is small.

The content V of H is set in the range of $0.01 \leqq V \leqq 10$ at. %. If the content of H is below 0.01 at. %, the aforementioned effect can not be sufficiently obtained. On the other hand, if the content of H exceeds 10 at. %, deterioration of saturation magnetization of the magnetic material is induced. The more preferable range of the content V of H is in the range of $0.1 \leqq V \leqq 5$ at. %. In such a range of the content of H, diffusion acceleration effect in particular of N can be heightened.

Further, the magnetic material expressed essentially by the aforementioned formula (1) allows to contain inevitable impurities such as oxide.

The magnetic material of the present invention having an aforementioned composition has a $TbCu_7$ type crystal phase as a principal phase. This can be easily confirmed by x-ray diffraction and the like. The magnetic material of which the $TbCu_7$ type crystal phase is the principal phase, compared with the magnetic material and the like in which a $Th_2Zn_{17}$ type crystal phase is the principal phase, possesses magnetic characteristics excellent in its high saturation magnetization and the like.

In particular, a $TbCu_7$ type crystal phase as a principal phase shows a larger saturation magnetization, in addition, can increase its remanent magnetization when the ratio c/a of its lattice constants is 0.845 and more. The ratio c/a of the lattice constants of the $TbCu_7$ type crystal phase can be controlled through composition of magnetic material and manufacturing method. Further, an average grain diameter of the $TbCu_7$ type crystal phase is preferable to be 50 nm or less.

By adjusting the average grain diameter of the $TbCu_7$ type crystal phase to 50 nm or less, the remanent magnetization is further enhanced, and the maximum magnetic energy product increases.

A principal phase of the magnetic material of the present invention indicates the largest one in its volume ratio in constituent phases including amorphous phase in an alloy. The magnetic material of the present invention may be one having a $TbCu_7$ type crystal phase as its principal phase, but, from magnetic characteristics and the like points of view, it is preferable to include 80% or more of the $TbCu_7$ type crystal phase by its volume ratio. The amorphous phase which deteriorates magnetic characteristics is preferable to be 10% or less by its volume ratio.

According to the present invention, through nitriding treatment in a mixed gas containing ammonia and hydrogen gas which can make rapidly absorb nitrogen in the magnetic material, the magnetic material having the aforementioned constituent phases can be efficiently obtained. Such a magnetic material, based on reduction and the like of the amorphous phase, exhibits excellent magnetic characteristics.

Magnetic material of the present invention can be manufactured, for instance, in the following manner.

First, a mother alloy is prepared with the method shown in the following (A) and (B).

(A) An ingot containing predetermined amounts of each element of $R^1$, $R^2$, M, B, further, according to demands, T element and the like is prepared with arc melting or high frequency melting. After the ingot is cut into chips and melted with high frequency induction melting and the like, the molten metal is sprayed on a single roll or a twin roll rotating with a high speed to rapidly cool. Aside from this, liquid rapid cooling method such as rotating disc method, gas atomizing method can be applied. (B) Through investment of mechanical energy to a mixed body of each raw material powder containing predetermined amounts of each element of $R^1$, $R^2$, M, B, further, according to demands, T element and the like, alloying is accomplished through a solid phase reaction. That is, a mother alloy is prepared with mechanical alloying or mechanical grinding. As a specific means allowing the solid phase reaction occur, a planetary mill, a rotating ball mill, an attritor, a vibration ball mill, a screw type ball mill can be employed.

In addition, in the aforementioned methods of (A) and (B), the rapid cooling step and solid phase reaction step are preferable to be carried out in an inert gas atmosphere such as Ar, He. Through rapid cooling or solid phase reaction in such an atmosphere, deterioration of magnetic characteristics due to oxidation can be prevented from occurring. The mother alloy obtained with the method of (A) or (B), according to demands, may be heat treated for 0.1 to 10 hours at a temperature of about 573 to 1273K in an inert gas atmosphere such as Ar, He or in vacuum. By carrying out such a heat treatment, magnetic characteristics such as coercive force can be improved.

Next, the mother alloy obtained with the aforementioned method of (A) or (B) can be pulverized to be several tens $\mu$m to several hundreds $\mu$m by a ball mill, a Brown mill, a stamping mill, a jet mill and the like. This powder of the mother alloy, in a mixed gas containing ammonia gas and hydrogen gas, is heat treated under a condition of a temperature of around 573 to 773K for 0.1 to 100 hour. This heat treatment is carried out as a step of nitriding treatment. In addition, since the mother alloy manufactured with the method of (B) is obtained in a powder state, the pulverizing step can be omitted.

This nitriding treatment (treatment for inclusion of nitrogen) is carried out in a mixed gas satisfying a partial pressure ratio of $3<P_y/P_x$, when partial pressure of ammonia gas is $P_X$, partial pressure of hydrogen gas is $P_Y$. The mixed gas containing ammonia gas and hydrogen gas exhibits an effect upon rapid absorption of nitrogen in the mother alloy of which the principal phase is a $TbCu_7$ type crystal phase, but, when the partial pressure of ammonia gas $P_X$ is high, that is, when the ratio $P_y/P_x$ is 3 or less, too much nitrogen is absorbed to increase the amorphous phase.

In other words, by heat treating the mother alloy in a mixed gas containing ammonia gas and hydrogen gas in which the ratio $P_y/P_x$ is set to be more than 3, without hindering rapid absorption of nitrogen, the increase of the amorphous phase due to absorption of too much nitrogen, and resultant deterioration of magnetic characteristics can be suppressed. Namely, the magnetic material represented by the aforementioned formula (1) and the like can be manufactured efficiently, and without deteriorating the magnetic characteristics.

The partial pressure ratio $P_y/P_x$ of those of ammonia gas and hydrogen gas is further preferable to be set at 5 or more. On the other hand, though ammonia gas exhibits its effect with an addition of only a small quantity, when the partial pressure ratio $P_y/P_x$ is too high, since the introducing efficiency of nitrogen becomes lower to lower the true productivity and the like, the partial pressure ratio $P_y/P_x$ is preferable to be set at 50 or less.

The mother alloy which is obtained with method of (A) or (B) and of which the principal phase is a $TbCu_7$ type crystal phase can be made such fine as a grain diameter of, for instance, 50 nm or less. In the case where such a microcrystalline alloy is subjected to nitriding treatment with use of a mixed gas containing ammonia gas and hydrogen gas, compared with the case where an alloy large in its grain diameter (for instance, $Sm_2Fe_{17}$ alloy in which $Th_2Zn_{17}$ type crystal phase is a principal phase) is subjected to nitriding treatment, too much nitrogen is prone to be absorbed. Therefore, if the partial pressure ratio $P_y/P_x$ is 3 or less, the amorphous phase is supposed to increase.

Further, the mixed gas to be employed in the nitriding treatment step can contain other component than ammonia gas and hydrogen gas. However, if the mixed gas contains too much oxygen gas, magnetic characteristics deteriorate due to formation of oxide during heat treatment, therefore partial pressure of oxygen gas is preferred to be 0.02 atmosphere or less.

Further, after the nitriding treatment step is carried out, in an inert gas atmosphere of, for instance, Ar and the like, or in vacuum, heat treatment at around 573 to 773K for about 0.1 to 100 hour may be carried out. By such a heat treatment, nitrogen in the magnetic material can be made homogenized, resulting in further improvement of magnetic characteristics.

The magnetic material of the present invention is suitable for a constituent material of, for instance, a bonded magnet. A bonded magnet comprises magnetic material powder and a binder bonding between magnetic material powders. In the following, a method for manufacturing a bonded magnet from the magnetic material of the present invention will be described. In addition, upon manufacturing a bonded magnet, conventionally, magnetic material is used after pulverization. However, in the manufacturing process of the aforementioned magnetic material, when pulverization has been already carried out, this process can be omitted.

(a) Powder of magnetic material of the present invention is mixed with an organic binder, which is compression molded or injection molded into a desired shape, thereby a bonded magnet is manufactured. As binder, for instance, resin such as epoxy derivatives, nylon derivatives can be used. When a thermosetting resin such as epoxy derivative resin is used as a binder, after casting in a desired shape, curing treatment is preferably carried out at temperature of about 373 to 473K. When a thermoplastic resin such as nylon derivative resin is used as a binder, injection molding is preferably employed. When a compression molded bonded magnet is manufactured, by aligning crystal directions through application of a magnetic field during compression, a permanent magnet of high magnetic flux density can be manufactured.

(b) After the powder of the magnetic material of the present invention is mixed with a low melting metal or a low melting alloy, through compression molding a metal bonded magnet is manufactured. In this case, the low melting metal or the low melting alloy functions as the binder. As low melting metals, for instance, Al, Pb, Sn, Zn, Cu, Mg and the like can be employed. As low melting alloys, alloys including the aforementioned low melting metals and the like can be employed. Also in this case, by aligning crystal directions through application of magnetic field, a permanent magnet of high magnetic flux density can be manufactured.

In the following, specific embodiments of the present invention and evaluated results will be described.

Embodiments 1 to 10

First, each raw material of high purity is compounded to be each composition (basically N and H are omitted) shown in Table 1. They are melted with high frequency melting in an Ar atmosphere to prepare an ingot of raw material, respectively. Then, these each raw material ingot is melted by high frequency induction heating in the Ar atmosphere, thereafter, each molten metal is sprayed on a metallic roll rotating with a peripheral speed of 35 m/s from a nozzle having a hole of a diameter of 0.5 mm to rapidly cool, thus each thin alloy strip is prepared.

Subsequently, the aforementioned each thin alloy strip is heat treated at 993K for 30 min. in Ar atmosphere. Upon carrying out X-ray diffraction to each heat treated thin alloy strip, except for diffraction peaks of an weak α-Fe phase, all peaks can be indexed to the $TbCu_7$ type crystal structure. Further, its ratio of lattice constants c/a was recognized to be within the range of 0.856 to 0.868. All the average grain diameters are 50 nm or less.

Next, each thin alloy strip is pulverized with a mortar to prepare alloy powder of average diameter of 80 to 300 μm. To make contain nitrogen in these alloy powders, each alloy powder is heat treated at temperature of 683 to 723K for 1.5 to 4.5 hour in a flow of a mixed gas of ammonia gas and hydrogen gas. The partial pressure ratio $P_y/P_x$ of partial pressure of ammonia gas $P_x$ and partial pressure of hydrogen gas $P_y$ are shown in Table 1, respectively.

Thereafter, heat treatment is carried out at the same temperature in Ar gas flow for 2 hours. Thereby, respective magnetic material is prepared. The compositions of the obtained magnetic materials are shown in Table 1. Further, the compositions shown in Table 1 are results obtained by analysis with ICP emission spectroscopy, combustion infrared absorption and high frequency heating thermal conductivity detection.

After 2% by weight of epoxy resin is added to thus obtained each magnetic material and is mixed, under a pressure condition of 1000 MPa, the mixture is compression molded. Further, by curing at a temperature of 423K for 2.5 hour, respective boded magnet is prepared. The obtained respective bonded magnet is measured of its coercive force, residual magnetic flux density, the maximum energy product. These results are shown together in Table 1.

COMPARATIVE EXAMPLES 1 TO 3

To each thin alloy strip prepared with an identical method as embodiment 1, as identical as embodiment 1, in Ar atmosphere, heat treatment and pulverization are carried out. Then, in a flow of a mixed gas of ammonia gas and hydrogen gas in which the ratio $P_y/P_x$ of ammonia gas partial pressure $P_x$ and hydrogen gas partial pressure $P_y$ is set at 2 (comparative example 1), 3 (comparative example 2), 4 (comparative example 3), respectively, heat treatment of 703K ×2 hour is carried out. Further, at the same temperature and in Ar atmosphere, heat treatment of 2 hour is carried out to prepare magnetic materials.

With the obtained respective magnetic material, as identical as embodiment 1, bonded magnets are prepared respectively. Coercive force, residual magnetic flux density, the maximum magnetic energy product of these each bonded magnet are measured. The results are shown together in Table 1.

TABLE 1

| | Magnetic material composition (at. %/bal. Denotes residual portion) | $P_y/P_x$ | Coercive force (kA/m) | Residual magnetic flux density (T) | The maximum magnetic energy product (kJ/m$^3$) |
|---|---|---|---|---|---|
| Embodiment 1 | $Sm_{6.5}Zr_{2.2}Co_{3.7}Ni_{0.1}B_{1.9}N_{14.5}H_{0.02}Febal$ | 21 | 620 | 0.75 | 75 |
| Embodiment 2 | $Sm_{6.5}Pr_{0.3}Zr_{2.4}Co_{3.8}C_{0.2}B_{1.9}N_{14.5}H_{0.11}Febal$ | 33 | 615 | 0.72 | 81 |
| Embodiment 3 | $Sm_{6.5}Ce_{0.3}Zr_{1.9}Co_{3.9}Ti_{1.0}B_{2.2}N_{15.1}H_{1.20}Febal$ | 50 | 644 | 0.72 | 80 |
| Embodiment 4 | $Sm_{6.1}Nd_{0.2}Zr_{2.1}Co_{3.0}Si_{1.3}B_{1.4}N_{15.0}H_{0.55}Febal$ | 23 | 623 | 0.75 | 77 |
| Embodiment 5 | $Sm_{6.2}Zr_{2.0}Nb_{0.2}Co_{4.0}Al_{0.3}P_{0.2}B_{2.5}N_{14.7}H_{0.03}Febal$ | 15 | 622 | 0.75 | 82 |
| Embodiment 6 | $Sm_{6.6}Nd_{0.3}Zr_{1.5}Co_{4.4}Mn_{0.2}W_{0.2}B_{2.0}N_{13.5}H_{0.02}Febal$ | 45 | 655 | 0.70 | 78 |
| Embodiment 7 | $Sm_{6.5}Zr_{1.8}Er_{0.1}Co_{9.5}Ga_{0.1}C_{0.2}B_{2.2}N_{14.2}H_{0.53}Febal$ | 8 | 606 | 0.75 | 75 |
| Embodiment 8 | $Sm_{6.6}Zr_{2.1}Ta_{0.1}Cr_{1.0}Co_{4.0}B_{2.7}N_{15.1}H_{0.33}Febal$ | 65 | 650 | 0.73 | 74 |
| Embodiment 9 | $Sm_{7.0}Ce_{0.2}Zr_{2.3}Sc_{0.1}V_{1.2}Co_{4.5}C_{1.3}N_{12.1}H_{1.00}Febal$ | 4 | 710 | 0.69 | 71 |
| Embodiment 10 | $Sm_{6.5}Nd_{0.3}Zr_{1.7}Co_{5.0}Sn_{0.1}P_{0.1}C_{1.2}N_{13.6}H_{0.42}Febal$ | 20 | 621 | 0.70 | 77 |
| Comparative example 1 | $Sm_{6.1}Zr_{2.0}Co_{3.6}Ni_{0.1}B_{1.6}N_{23.4}H_{1.33}Febal$ | 2.2 | 406 | 0.53 | 47 |
| Comparative example 2 | $Sm_{6.3}Zr_{2.1}Co_{3.6}Ni_{0.1}B_{1.8}N_{21.3}H_{0.85}Febal$ | 2.5 | 501 | 0.57 | 58 |
| Comparative example 3 | $Sm_{6.4}Zr_{2.1}Co_{3.7}Ni_{0.1}B_{1.9}N_{19.8}H_{1.28}Febal$ | 2.8 | 558 | 0.64 | 63 |

As evident from Table 1, all of the magnetic materials of each embodiment, in which the ratio ($P_y/P_x$) of the partial pressure $P_x$ of ammonia gas and that $P_y$ of hydrogen gas is 5 or more, contain appropriate amount of nitrogen, thereby excellent magnetic characteristics are obtained. On the other hand, all the magnetic materials according to each comparative example contain too much nitrogen, thereby magnetic characteristics are largely deteriorated.

Thus, according to the present invention, without hindering the rapid absorption of nitrogen, increase of amorphous phase due to too much absorption of nitrogen and deterioration of the magnetic characteristics based thereon can be suppressed. Therefore, it becomes possible to provide efficiently magnetic material having excellent magnetic characteristics.

What is claimed is:

1. A method of manufacturing a magnetic material, the method comprising a step of preparing a mother alloy by liquid rapid cooling, mechanical alloying, or mechanical grinding, the mother alloy comprising a composition essentially represented by a general formula $$R^1_X R^2_Y B_Z M_{100-X-Y-Z},$$

where $R^1$ denotes at least one element selected from rare earth elements, $R^2$ denotes at least one element selected from Zr, Hf and Sc, M denotes at least one element selected from Fe and Co, and X, Y and Z are numbers satisfying 2 at. %≦X, 0.01 at. %≦Y, 4 ≦X+Y ≦20 at. %, and 0≦Z ≦10 at. %, respectively;

a step of heat treating the mother alloy at a temperature of 573 to 1273 K in an inert gas atmosphere or vacuum to obtain a $TbCu_7$ crystal phase as a principal phase of the mother alloy; and a step of introducing nitrogen into the heat treated mother alloy to obtain the magnetic material comprising the $TbCu_7$ crystal phase as a principal phase, wherein the step of introducing nitrogen comprises heat treating the mother alloy in a mixed gas of ammonia gas and hydrogen gas satisfying a partial pressure ration of $3<P_y/P_x$, where $P_y$ is the partial pressure of the hydrogen gas in the mixed gas and $P_x$ is the partial pressure of the ammonia gas in the mixed gas.

2. The method according to claim 1, wherein the magnetic material comprises a composition essentially represented by the general formula $$R^1_X R^2_Y B_Z N_U H_V M_{100-X-Y-Z-U-V},$$

where 2 at. %≦X, 0.01 at. %≦Y,

4≦X+Y≦20 at. %,

0≦Z≦10 at. %, 0.1≦U≦18 at. %, and 0.1≦V≦10 at. %, respectively.

3. The method according to claim 1, wherein the mixed gas of the ammonia gas and the hydrogen gas satisfies a partial pressure ratio in the range of $5 \leqq P_y/P_x \leqq 50$.

4. The method according to claim 1, wherein the step of introducing nitrogen is carried out at a temperature of 573 to 773 K for 0.1 to 100 hours.

5. The method according to claim 1, wherein the mother alloy comprises a powder having an average diameter of 80 to 300 $\mu$m.

6. The method according to claim 1, wherein the TbCu, crystal phase of the mother alloy has an average grain diameter of 50 nm or less.

7. The method according to claim 1, wherein the magnetic material contains 80% or more by volume of the TbCu, crystal phase.

8. The method according to claim 2, wherein 0.1≦V≦5 at. %.

9. The method according to claim 2, wherein 2≦X≦16 at. %.

10. The method according to claim 2, wherein 50 at. % or more of the $R^1$ is Sm.

11. The method according to claim 2, wherein 1≦Y≦3 at. %.

12. The method according to claim 2, wherein the magnetic material contains 70 at. % or more of the M.

13. The method according to claim 2, wherein 0.001≦Z≦4 at. %.

14. The method according to claim 2, further comprising substituting 20 at.% or less of the M with at least one element selected from the group consisting of Ti, V, Cr, Mo, W, Mn, Ga, Al, Sn, Ta, Nb, Si and Ni.

15. The method according to claim 2, further comprising substituting 50 at. % or less of the N element with at least one element selected from the group consisting of C and P.

16. The method according to claim 1, further comprising a step of molding a mixture of the magnetic material and a binder to obtain a bonded magnet.

* * * * *